US006468071B2

(12) United States Patent
Zou

(10) Patent No.: US 6,468,071 B2
(45) Date of Patent: Oct. 22, 2002

(54) PRAYER CANDLE DEVICE

(76) Inventor: Cindy Zou, 2331 Finlandia La., Apt. 81, Clearwater, FL (US) 33763

( * ) Notice: Subject to any disclaimer, the term of this patent is extended or adjusted under 35 U.S.C. 154(b) by 0 days.

(21) Appl. No.: 09/846,953

(22) Filed: May 2, 2001

(65) Prior Publication Data

US 2002/0018976 A1 Feb. 14, 2002

Related U.S. Application Data

(63) Continuation-in-part of application No. 09/535,721, filed on Mar. 27, 2000, now Pat. No. 6,267,584.

(51) Int. Cl.[7] ..... F21V 35/00

(52) U.S. Cl. ..... 431/290; 431/126; 431/291; D26/9

(58) Field of Search ..... 431/126, 288, 431/289, 290, 291, 292, 296; 44/275; D26/9, 16, 22, 23; 362/161, 228, 392, 569, 808, 810

(56) References Cited

U.S. PATENT DOCUMENTS 2,717,306 A * 9/1955 Meara ..... 431/290
5,057,005 A * 10/1991 Kwok ..... 431/289

FOREIGN PATENT DOCUMENTS

GB 2230888 A * 10/1990 ..... 40/547

* cited by examiner

*Primary Examiner*—Sara Clarke
(74) *Attorney, Agent, or Firm*—John Lezdey

(57) ABSTRACT

A prayer candle device includes a tubular body having a chamber provided therein, a consumable lighting element refillably disposed in the chamber including a wick mounted in the consumable lighting element, a holding device mounted in the chamber of the tubular body for holding. the consumable lighting element in position, and an adjusting device for maintaining a burning end of the wick of the consumable lighting. element at an upper position by sensing infrared radiation from a burning wick.

15 Claims, 3 Drawing Sheets

PRAYER CANDLE DEVICE

RELATED APPLICATIONS

This application is a continuation-in-part of application Ser. No. 09/535,721 filed Mar. 27, 2000, U.S. Pat. No. 6,267,584.

FIELD OF THE INVENTION

The present invention relates to prayer and holiday candle devices and more particularly to a prayer candle device, which can provide a good atmosphere and decorative function. There is also provided a candle device with light and/or sound.

DESCRIPTION OF RELATED ARTS

Historically, people use candies at home, church, or other places of worship to provide an atmospheric or decorative touch. In order to hold the candle in place, a candle container is used to prevent the candle from accidentally falling out and starting a fire. The conventional candle container comprises a hollow cylindrical body having a candle cavity therein, so that a candle can be inserted into the candle cavity. A spring is also inserted in the candle cavity so as to normally urge the candle upwardly to maintain a burning end thereof at an upper position.

However, after the burning end of the candle inside the candle container is ignited, the consumable material, such as wax, of the candle starts melting. The melted consumable material will flow back into the candle container, such that when the consumable material is condensed inside the candle cavity, the rest of the unburned candle may stick inside the candle container and it is hard to clean up. Some melted candle materials may flow out of the candle container and stick on the outer surface thereof. Accordingly, the melted candle material not only destroys the beauty of the candle container but also damages the decoration surface of the candle container.

Some improved candle containers comprise a drain opening such that when the candle material flows into the interior of the candle container, a user is capable of flushing the accumulated candle material through the drain opening. However, when the candle material is condensed at the bottom of the candle cavity where the spring is positioned, the spring may lose its elastic property while the candle material is stuck around the spring. The user may need to replace the spring as well or. flush all the candle material several times within lighting one candle. So, the conventional candle container has some drawbacks on usage under certain circumstances.

SUMMARY OF THE PRESENT INVENTION

A main object of the present invention is to provide a prayer or holiday candle device, which can provide a good atmosphere and decorative function.

Another object of the present invention is to provide a prayer or holiday candle device, which is adapted for operating by a regular consumable candle with wick.

Another object of the present invention is to provide a prayer or holiday candle wherein the melted candle material may flow into a collecting chamber in order to prevent the malfunction of the operation.

A further object of the invention is to provide a prayer or holiday candle device having sound and/or light effects.

Accordingly, in order to accomplish the above objects, the present invention provides a prayer or holiday candle device, which comprises:

a tubular body having a chamber therein, an open end defining a supporting rim and a base at the bottom;

a consumable lighting element mounted on a movable platform and refillably disposed in the chamber of the tubular body, comprising a wick mounted therein, which emits infrared radiation when lit;

optionally, means for generating or recording sound and/or light;

a cover, which is fittedly disposed on the supporting rim of the tubular body, having a hole provided thereon, wherein the wick of the consumable lighting element is adapted to be penetrated through the hold to the outside; and motor means activated by the presence or absence of infrared radiation for urging a burning end of the wick of the consumable lighting element at an upper position.

It is understood that the term consumable lighting element is meant to include candle, gel, votive or the like and the terms are interchangeable.

The objects and advantages of the present invention will be better understood by a reading of the description of preferred embodiments together with the drawings.

DESCRIPTION OF THE PREFERRED EMBODIMENTS

Figure 1:
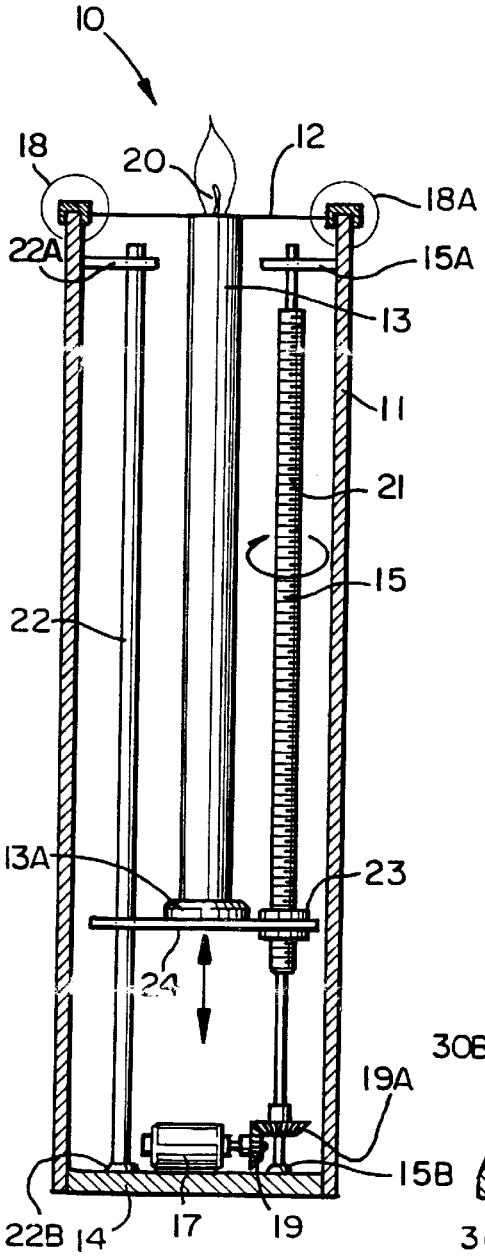
FIG. 1 is a sectional view of a candle device according to a first preferred embodiment of the present invention.

Referring to FIG. 1 of the drawings, a candle device 10 according to a first preferred embodiment of the present invention is illustrated, which comprises a tubular body 11, a consumable lighting element such as a candle 13, having a wick 20, a platform 14, with candle holder 13A, a motor 17 for raising said platform 24 in response to infrared radiation.

The tubular body 11 has an open end defining a supporting rim on which the cover 12 sits and a base 14 for stabilizing the prayer candle device 10. The consumable lighting element 13 is refillably disposed in the chamber of the tubular body 11.

As illustrated in FIG. 1, a motor 17 mounted on the base 14 of the tubular member 11 of device 10 is associated with an infrared sensor 18, which is mounted about the cover 12. There is associated with sensor 18 an infrared amplifier 18A, which amplifies infrared radiation from said wick 20. When the sensor 18 and amplifier 18A are above the cover 12, the motor 17 is programmed to activate when the infrared radiation is reduced so as to raise the platform 24 and stop when the radiation reaches a programmed level below the cover 12.

When the sensor 18 and amplifier 18A are below the cover 12, the motor 17 is activated when the infrared radiation is measured below the cover 12 as a result of consumption of the candle to activate the motor 17 to raise the platform 24 so as to expose the burning wick 20 and stop when the infrared radiation is reduced.

The platform 24 can be raised when the motor 17, which is activated by the sensor 18 rotates taper gear driver 19 that is associated with a taper gear 19A, which in turn rotates the spiral rod screw 21 so as to cause the platform 24 to rise. The platform 24 is stabilized at one end by traveling on a pole or rod 22, which is fixed in the base 14 with fixative 22B and about the top of the tubular body with fixative 22A. The spiral rod screw 21 is fixed in the base 14 with fixative 15B and about the top of the tubular body with fixative 15A.

When the motor 17 is on, the movement of the spiral rod 21 causes the nut 23, which is associated with the platform 24, to move along threads 15. Subsequently with the movement of the nut 23, the platform moves upward in a vertical direction.

The ascending of the candle is controlled by the infrared sensor 18, which controls the ON and OFF position of the motor 17. The infrared signal is emitted at approximately six-second intervals as the candle bums. The infrared emission is amplified by amplifier 18A, which sends a signal to sensor 18. Sensor 18 in turn pulses a signal to drive the motor 17.

Figure 2:
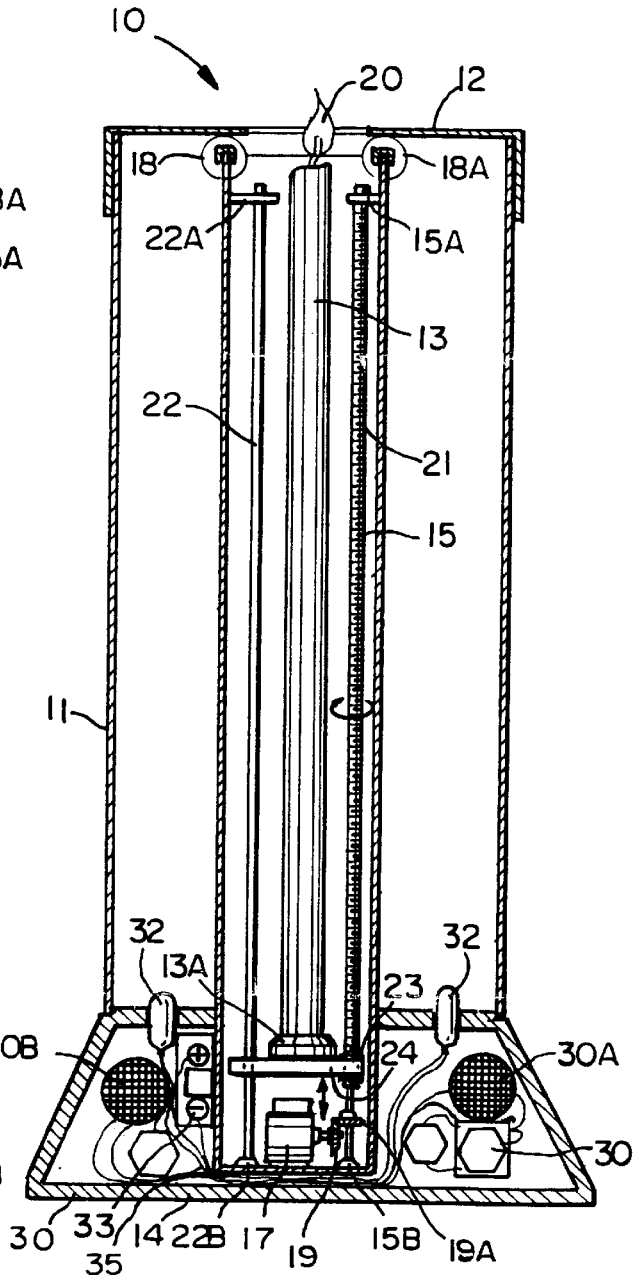
FIG. 2 is a sectional view of the candle device of the invention with sound and light elements.

As shown in FIG. 2, a candle device 10 of the invention can be provided with a base 30, which houses the motor 17 in addition to a sound recording device 30 with speaker 30A and receiver 30B.

Additionally, there may be provided a lighting element such as a light bulb or LED 32, which can illuminate the inside of the candle device or the outside. A battery 33 can be associated to provide power to the sound device 30A, 30B and to power the lighting elements 32, which are preferably LEDs.

The lighting elements 32 comprise a plurality of lighting elements such as light bulbs or LEDs encirclingly and evenly mounted on the base, a power supply, such as rechargeable battery 33 for providing electrical power to the lighting elements mounted at the bottom of the base 30, and a plurality of connecting wires 35 connected between the power supply and the lighting elements 32 respectively. So, when the candle 13 is not in use or is used up, the lighting elements 32 can substitute for the candle in order to light up the prayer candle device 10. Moreover, the lighting elements 32 can further provide an esthetically pleasing appearance and decorative touch a the prayer candle device of the present invention.

Additionally, the candle device 10 as shown in FIG. 2, comprises a sound generating means which comprises a tape recorder installed at the bottom of the base and at least a speaker for outputting sound signal affixed on an outer surface of the base 30. The power supply 33 is mounted at the bottom of the base 30 near the tape recorder and the connecting wires for electrically connecting between the tape recorder, the speaker and the power supply 333 by means of a closed circuit such that the sound generating means is adapted for generating sound such as songs and praying messages from a prerecorded tape or to record a message or music.

Figure 3:
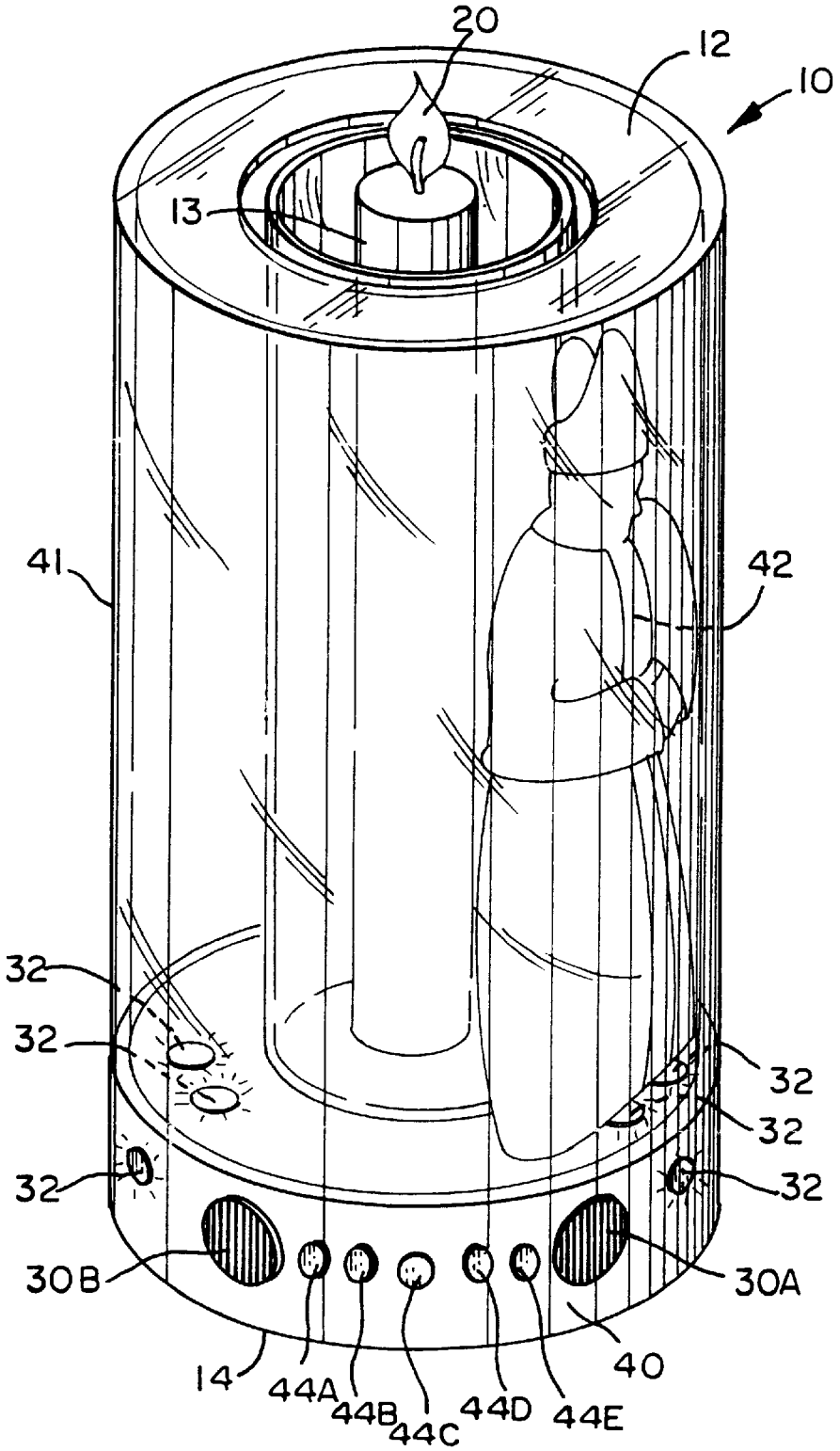
FIG. 3 is a perspective view of the candle device according to a further embodiment of the present invention.

FIG. 3 illustrates a further embodiment of the invention wherein candle device 10 is provided with an enlarged base 40 so that a further tubular member 41 having a FIG. 42 representing a religious or holiday theme, or any other occasion is found on the tubular member 41. Preferably the FIG. 42 inside or outside of the tubular member 41 is three-dimensional and can cast an image as a result of the lighting element 32. Circling the outside of the base 40 can be a plurality of LEDs.

The base 40 may be provided with control buttons for controlling the various activities. For example, button 44A can be an ON and OFF button which controls the LEDs. Buttons 44B and 44C can control sound recording and sound repeating means. Button 44D can reverse the motor so as to cause the platform to descend to replace the candle. Button 44E can be used to activate or turn off the power supply.

Preferably the tubular member 41 may be made of transparent material such as crystal or glass so that the light can be reflected through the tubular body 41 for providing an esthetically pleasing appearance. Furthermore, a three-dimensional figure of decorations such as angels, flowers, "JESUS CHRIST", a "POPE", "JOHN PAUL", "SANTA CLAUS" or the like can be attached inside and/or formed on the inner or outer surface of the tubular body 41 for further providing an atmospheric or decorative touch.

The candle holding means 13A is a tubular container, preferably made of transparent material such as crystal or glass, wherein the holding means 13A has a diameter slightly larger than the diameter of the candle 13 and smaller than a diameter of the tubular body 10. Furthermore, the holding means 30 is detachably mounted at its bottom in the chamber 11 of the tubular body 10. Preferably, the holding means 30 is screwed on the tubular body 10, so that a user can detach the holding means 30 for easy cleanup and fittingly placing the consumable lighting element 20 therein.

Figure 4:
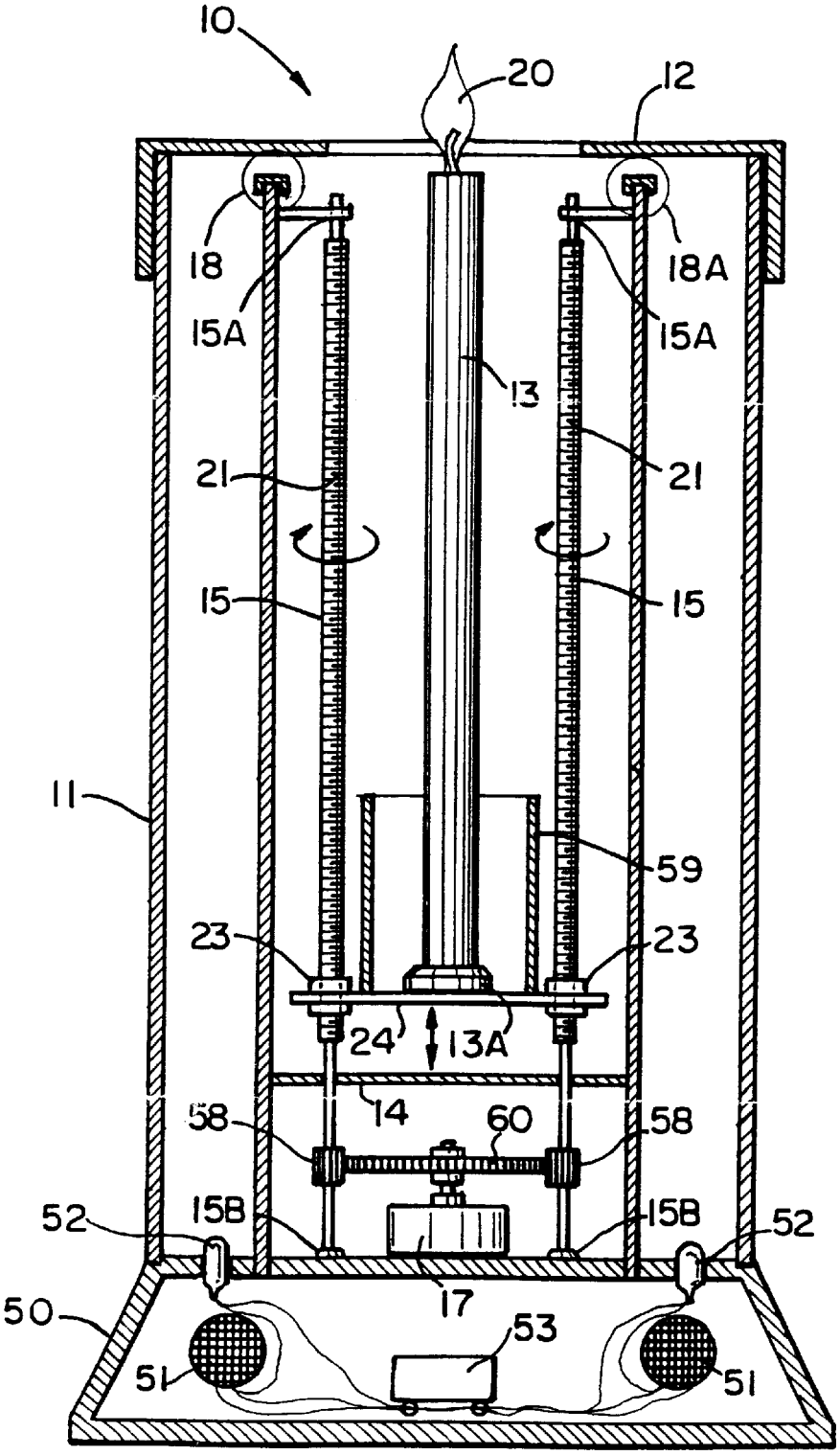
FIG. 4 is a sectional view of the candle device according to a further embodiment of the present invention.

FIG. 4 illustrates a further embodiment of the invention wherein a separable base 50 is provided, which houses a sound receiver or play and LEDs 52, which are associated with a battery 53. Mounted on the base 50 is the candle device which comprises a first tubular member 59, which encircles the base of the candle 13 at its lower end to catch the drippings from the burning candle.

A second tubular member 11 surrounds the candle 13 and the mechanism for raising and lowering the platform 14. The tubular member 11 sits on the base 50. Tubular body 11 has a cover 12 through which the wick ends. The infrared amplifier 18A and the infrared receiver 18, which receives the signals from the amplifier 18A, can either be above the cover 12 or below the cover 12.

Within tubular member 11 is also housed on the top of the base 50 the motor 17, which is activated in response to the infrared signals. Motor 17 is associated with means 58, 60 for rotating the screw rods 15, which cause the platform to move upward or when reversed downward.

Optionally, the infrared receiver 18 and infrared amplifier or emitter 18A can be mounted on the inside of the tube member 59 and so as to receive signal when the burning wick is below cover 12.

At the top of the base 50 are the LEDs 52, which are associated with a power source 53 that is preferably a rechargeable battery. The base also has opening for a sound reproducer and/or player 51. The sound reproducer and/or generator can consist of a tape recorder and/or player or the like.

What is claimed is:

1. A candle device, comprising:

a tubular body having a chamber therein, an open end defining a supporting rim and a base;

a consumable lighting element having a wick and disposed in said chamber of said tubular body, and mounted on a platform; said wick when lit emitting infrared radiation;

a cover, which is fittedly disposed on said supporting rim of said tubular body, having a through hole provided thereon, wherein said wick of said consumable lighting element penetrates through said hole to the outside;

means for urging a burning end of said wick of said consumable lighting element at its upper position, through said cover said means comprises a motor means for raising said platform so that the wick protrudes from said cover; said motor means being activated by the infrared radiation emitted above or below said cover.

2. The candle device of claim 1 comprising means for generating light and/or sound means mounted on said base of said tubular body, and power supply means associated with said light and sound generating means.

3. The candle device, according to claim 1, wherein said platform is raised pursuant to the degree of infrared radiation above or below said cover.

4. The candle device, according to claim 3 wherein said motor means is mounted on the base for raising and lowering said platform.

5. The candle device, as recited in claim 4, wherein said platform is mounted on at least one spiral screw rod.

6. The prayer candle device, as recited in claim 1, including a lighting means mounted on said base, a power supply for providing electrical. power to said lighting means, and a plurality of connecting wires each connected between said battery and said lighting means.

7. A candle device, as recited in claim 6 including sound generating means mounted about a bottom of said base.

8. The candle device, as recited in claim 1 further comprising at least one three-dimensional figure or decoration mounted on said tubular body.

9. A candle device, comprising:

a tubular body having a chamber therein, an open end defining a supporting rim and a base;

a lighting element comprising a candle having a wick and disposed in said chamber of said tubular body and mounted on a platform, said wick, when lit emitting infrared radiation;

a cover, which is disposed on said supporting rim of said tubular body, having a through hole provided thereon, wherein said wick of said consumable lighting element penetrates through said through hole to the outside;

means-for raising .said platform so as to urge the burning end of said wick of said candle at its upper position, through said hole in the cover; said means responsive to the infrared radiation emitted from the wick; and a lighting means and a sound generating means mounted on said base of said tubular body, and a power supply for providing electrical power to said lighting means and said sound generating means mounted on said base.

10. The candle of claim 9 wherein said lighting means comprises LEDs.

11. The candle device, of claim 9 wherein said sound generating means comprises a tape recorder installed at a bottom of said base, a speaker for outputting sound affixed on an outer surface of said base, a power supply mounted at said bottom of said base near to said tape recorder, and a plurality of connecting wires for electrically connecting between said tape recorder, said speaker and said power supply in a closed circuit.

12. The candle device of claim 9 wherein said means for raising said platform comprises a motor.

13. The candle device of claim 12 wherein infrared radiation below said rim activates said motor so as to raise said platform.

14. The candle device of claim 12 wherein infrared radiation above said rim deactivates said motor and stops raising said platform.

15. The candle device of claim 12 wherein said platform is mounted on at least one spiral rod, which raises said platform when said motor means is activated.

* * * * *